US011135843B2

(12) United States Patent
Yamamoto et al.

(10) Patent No.: US 11,135,843 B2
(45) Date of Patent: Oct. 5, 2021

(54) LIQUID EJECTION HEAD

(71) Applicant: Brother Kogyo Kabushiki Kaisha, Nagoya (JP)

(72) Inventors: Jiro Yamamoto, Nagoya (JP); Shohei Koide, Nagoya (JP); Keita Hirai, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/835,568

(22) Filed: Mar. 31, 2020

(65) Prior Publication Data

US 2020/0307215 A1 Oct. 1, 2020

(30) Foreign Application Priority Data

Apr. 1, 2019 (JP) ..... JP2019-069603

(51) Int. Cl.
*B41J 2/14* (2006.01)
*B41J 2/18* (2006.01)

(52) U.S. Cl.
CPC ..... *B41J 2/14233* (2013.01); *B41J 2/14032* (2013.01); *B41J 2/1433* (2013.01); *B41J 2/14209* (2013.01); *B41J 2/18* (2013.01); *B41J 2002/14306* (2013.01); *B41J 2002/14419* (2013.01); *B41J 2202/07* (2013.01); *B41J 2202/12* (2013.01)

(58) Field of Classification Search
CPC ..... B41J 2/14233; B41J 2/14209; B41J 2/18; B41J 2202/12; B41J 2/1433; B41J 2/14032; B41J 2002/14306; B41J 2002/14419
See application file for complete search history.

(56) References Cited

U.S. PATENT DOCUMENTS

| | | | | |
|---|---|---|---|---|
| 10,207,509 | B2 * | 2/2019 | Odaka | B41J 2/185 |
| 2017/0096015 | A1 | 4/2017 | Odaka et al. | |
| 2020/0207090 | A1 | 7/2020 | Miyagishi | |

FOREIGN PATENT DOCUMENTS

| | | | |
|---|---|---|---|
| JP | 2017-065249 | A | 4/2017 |
| JP | 2017-077643 | A | 4/2017 |

* cited by examiner

*Primary Examiner* — Geoffrey S Mruk
(74) *Attorney, Agent, or Firm* — Banner & Witcoff, Ltd.

(57) ABSTRACT

In a liquid ejection head, an ejection pressure is applied to a pressure chamber for liquid ejection from a nozzle. A descender extends in a first direction and includes a first end connected to the pressure chamber and a second end. A communication passage is connected to the second end, extends in a second direction crossing the first direction, and has a first dimension in the first direction. The nozzle is positioned at the communication passage such that a shortest distance between an outer periphery thereof and a center of the second end is greater than 0.5 times a second dimension of the second end in the second direction. When viewed in the first direction, the center of the second end and a center of a cross-section defined by the nozzle to be orthogonal to an extending direction of the nozzle intersect an axis of the communication passage.

25 Claims, 7 Drawing Sheets

LIQUID EJECTION HEAD

CROSS-REFERENCE TO RELATED APPLICATION

This application claims priority from Japanese Patent Application No. 2019-069603 filed on Apr. 1, 2019, the content of which is incorporated herein by reference in its entirety.

TECHNICAL FIELD

Aspects of the disclosure relate to a liquid ejection head.

BACKGROUND

A known liquid ejection head includes a nozzle for ejecting liquid, an individual liquid chamber communicating with the nozzle, and a circulation channel communicating with the individual liquid chamber. Liquid flows in the individual liquid chamber in a first direction, and liquid flows in the circulation channel in a second direction crossing the first direction. In this case, a liquid inlet opening of the nozzle is positioned adjacent to a region where the liquid flow changes from the first direction to the second direction.

SUMMARY

In the known ink ejection head, the flow velocity is low in the region where the liquid flow changes from the first direction to the second direction. At the liquid inlet opening positioned in such a region, the liquid flow which is low in flow velocity is not able to adequately discharge air bubbles adhering to an inner wall surface of the nozzle. Thus, air bubbles absorb the pressure, causing an ink ejection failure from the nozzle.

Aspects of the disclosure provide a liquid ejection head configured to reduce ejection failures due to air bubbles.

According to one or more aspects of the disclosure, a liquid ejection head includes a pressure chamber, a descender, and a communication passage. An ejection pressure is applied to the pressure chamber for liquid ejection from a nozzle. The descender extends in a first direction and includes a first end connected to the pressure chamber and a second end opposite to the first end. The communication passage is connected to the second end, extends in a second direction crossing the first direction, and has a first dimension in the first direction. The nozzle is positioned at the communication passage such that a shortest distance between an outer periphery thereof and a center of the second end is greater than 0.5 times a second dimension of the second end in the second direction. When viewed in the first direction, the center of the second end of the descender and a center of a cross-section defined by the nozzle to be orthogonal to an extending direction of the nozzle intersect an axis of the communication passage.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Illustrative embodiments of the disclosure will be described with reference to the drawings.

First Illustrative Embodiment

Structure of Liquid Ejection Apparatus

A liquid ejection apparatus 10 including a liquid ejection head 20 (hereinafter referred to as a "head") according to a first illustrative embodiment is configured to eject liquid. Hereinafter, the liquid ejection apparatus 10 will be described by way of example as applied to, but not limited to, an inkjet printer.

Figure 1:
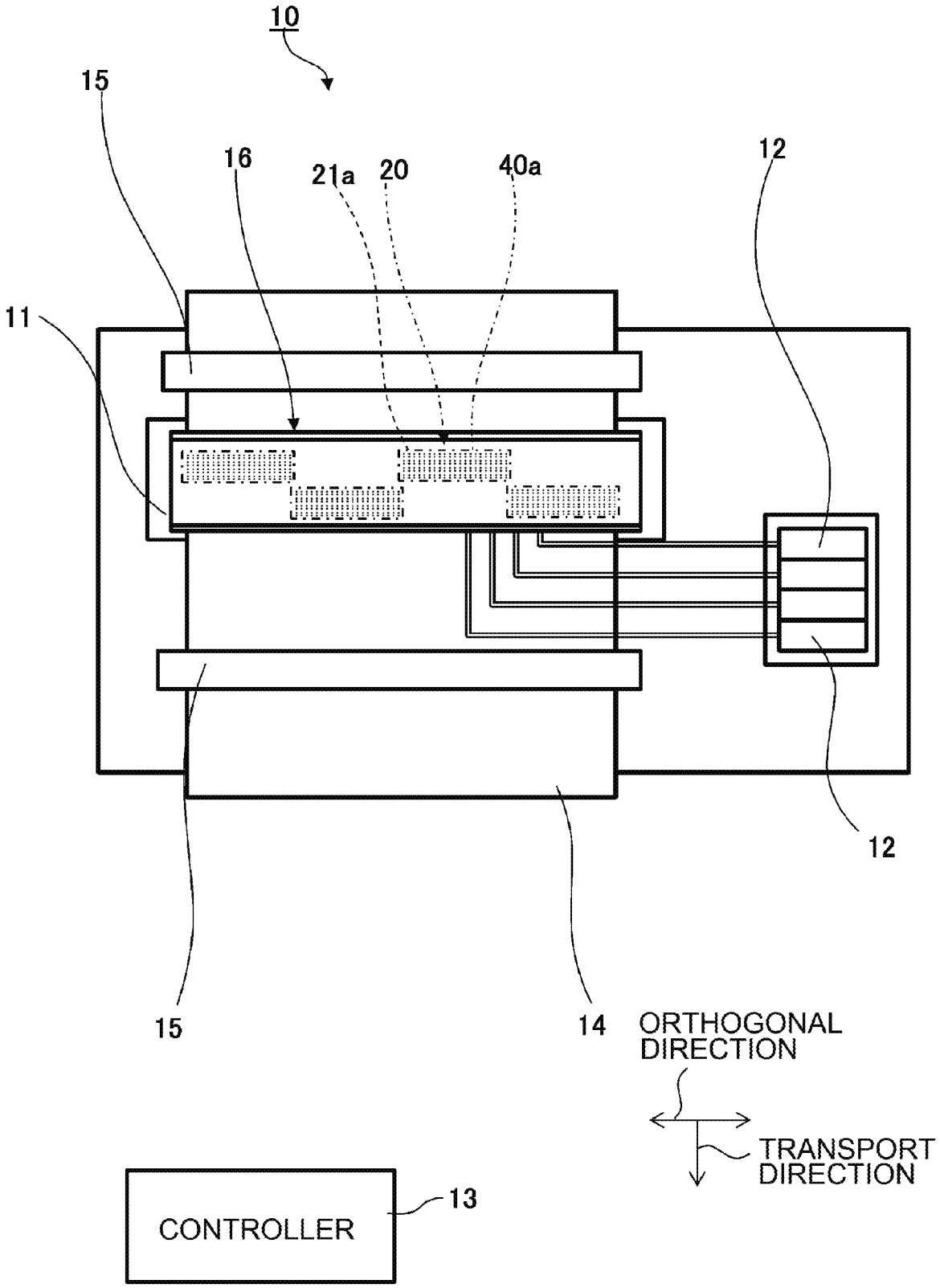
FIG. 1 is a schematic diagram of a liquid ejection apparatus including a liquid ejection head according to a first illustrative embodiment.

As shown in FIG. 1, the liquid ejection apparatus 10 employs a line head type and includes a platen 11, a transport unit, a head unit 16, a tank 12, and a controller 13. The liquid ejection apparatus 10 may employ a serial head type or other types than the line head type.

The platen 11 is a flat plate member to receive thereon a sheet 14 and adjust a distance between the sheet 14 and the head unit 16. Herein, one side of the platen 11 toward the head unit 16 is referred to as an upper side, and the other side of the platen 11 away from the head unit 16 is referred to as a lower side. However, the liquid ejection apparatus 10 may be positioned in other orientations.

The transport unit may include two transport rollers 15 and a transport motor (not shown). The two transport rollers 15 are disposed parallel to each other while interposing the platen 11 therebetween in a transport direction, and are connected to the transport motor. When the transport motor is driven, the transport rollers 15 rotate to transport the sheet 14 on the platen 11 in the transport direction.

The head unit 16 has a length greater than or equal to the length of the sheet 14 in a direction (an orthogonal direction) orthogonal to the transport direction of the sheet 14. The head unit 16 includes a plurality of heads 20.

Each head 20 includes a stack structure including a channel unit and a volume changer. The channel unit includes liquid channels formed therein and a plurality of nozzle holes 21*a* open on a lower surface (an ejection surface 40*a*). The volume changer is driven to change the volume of a liquid channel In this case, a meniscus in a nozzle hole 21*a* vibrates and liquid is ejected from the nozzle hole 21*a*. The head 20 will be described in detail later.

Separate tanks 12 are provided for different kinds of inks. For example, each of four tanks 12 stores therein a corresponding one of black, yellow, cyan, and magenta inks. Inks of the tanks 12 are supplied to corresponding nozzle holes 21*a*.

The controller 13 includes a processor such as a central processing unit (CPU), memories such as a random access memory (RAM) and a read only memory (ROM), and driver integrated circuits (ICs) such as an application specific integrated circuit (ASIC). In the controller 13, upon receipt of various requests and detection signals from sensors, the CPU causes the RAM to store various data and outputs various execution commands to the ASIC based on programs stored in the ROM. The ASIC controls the driver ICs based on the commands to execute required operation. The transport motor and the volume changer are thereby driven.

Specifically, the controller 13 executes ejection from the head unit 16, and transport of sheets 14. The head unit 16 is controlled to eject ink from the nozzle holes 21*a*. A sheet 14 is transported in the transport direction intermittently by a predetermined amount. Printing progresses by execution of ink ejection and sheet transport.

Structure of Head

Figure 2:
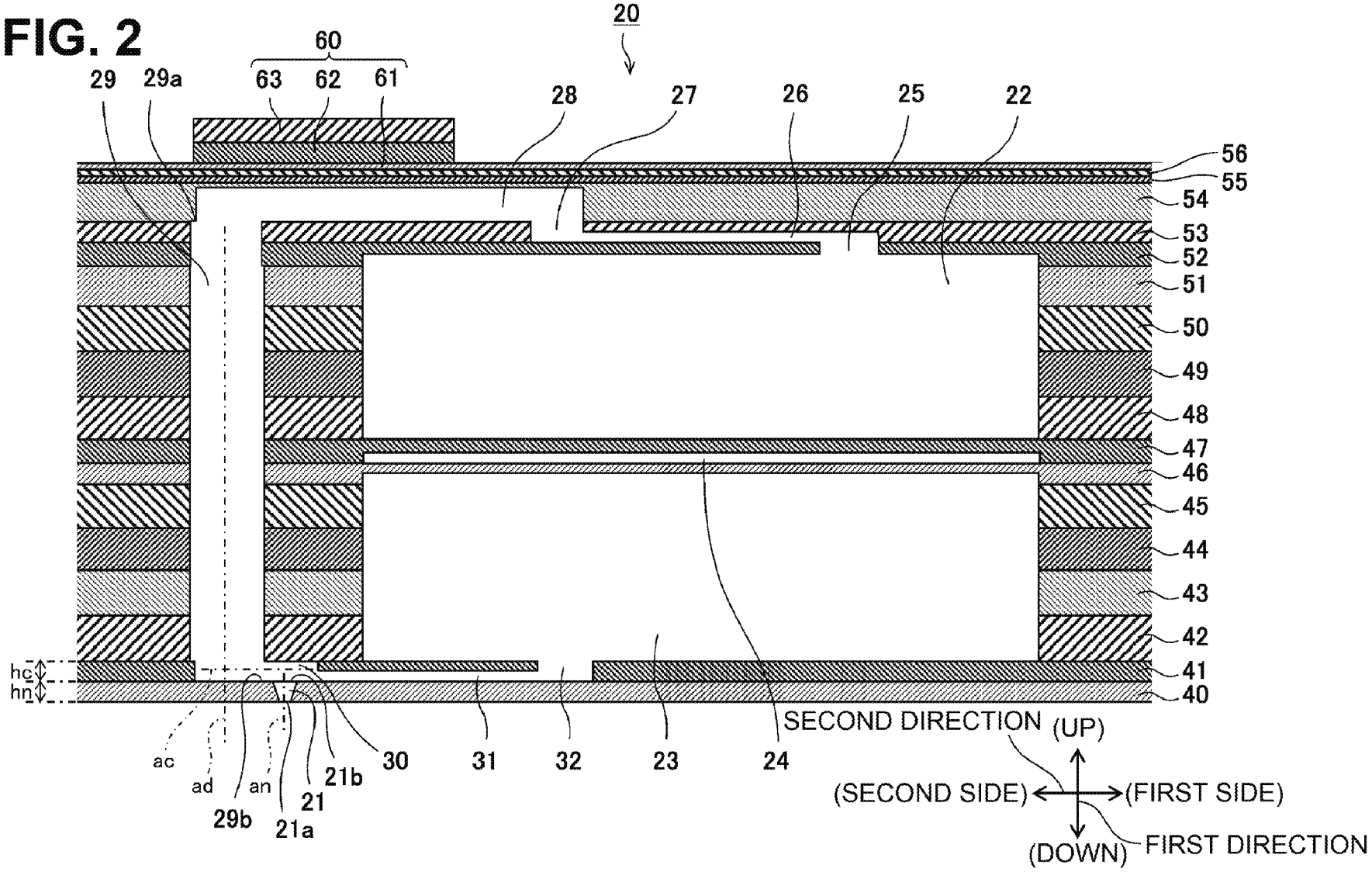
FIG. 2 is a cross-sectional view of the liquid ejection head of FIG. 1 taken along a line orthogonal to a third direction of the liquid ejection head.
Figure 3:
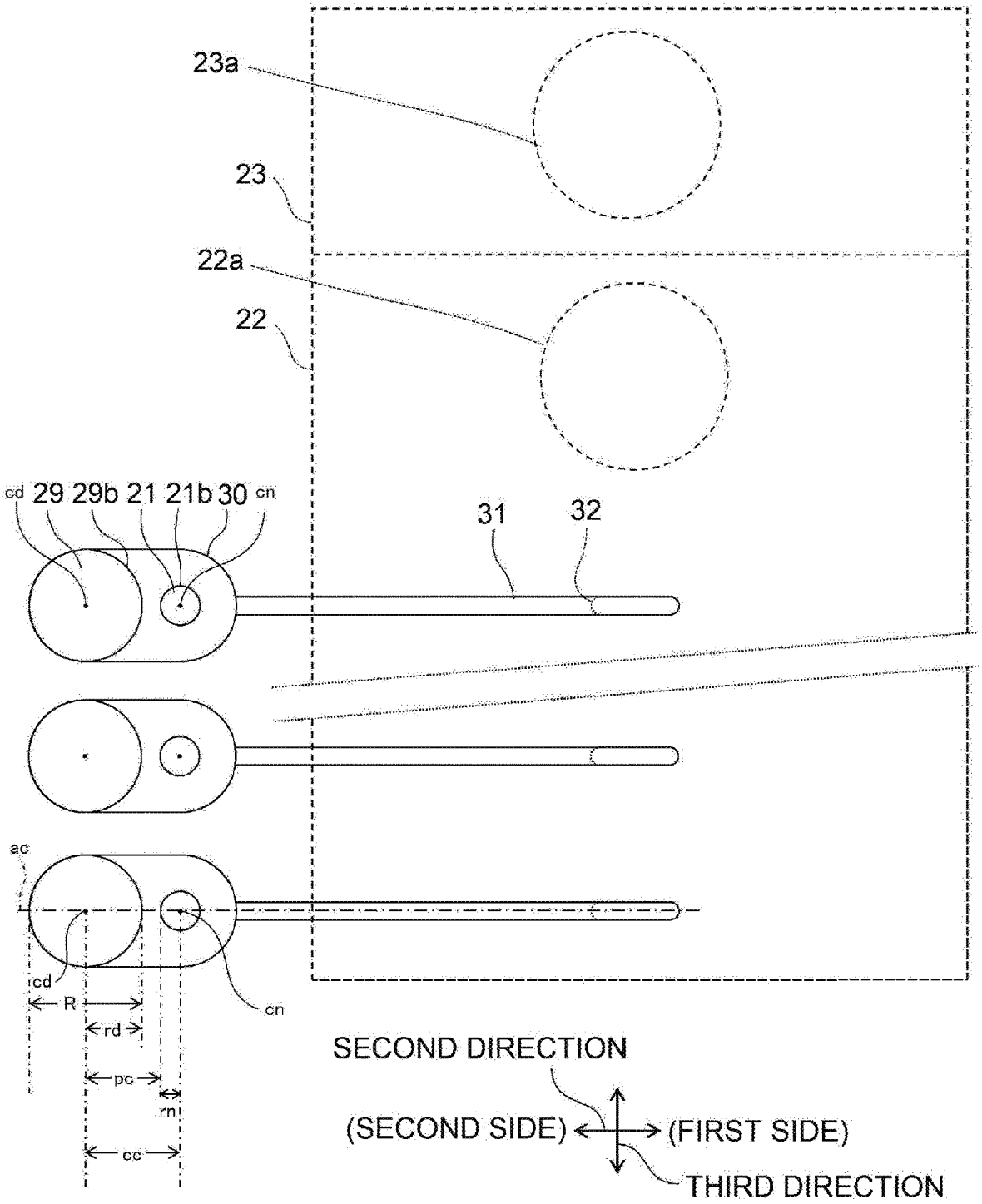
FIG. 3 is a view, when viewed in a first direction, showing a positional relation of a descender, a communication passage, and a nozzle.
Figure 4A:
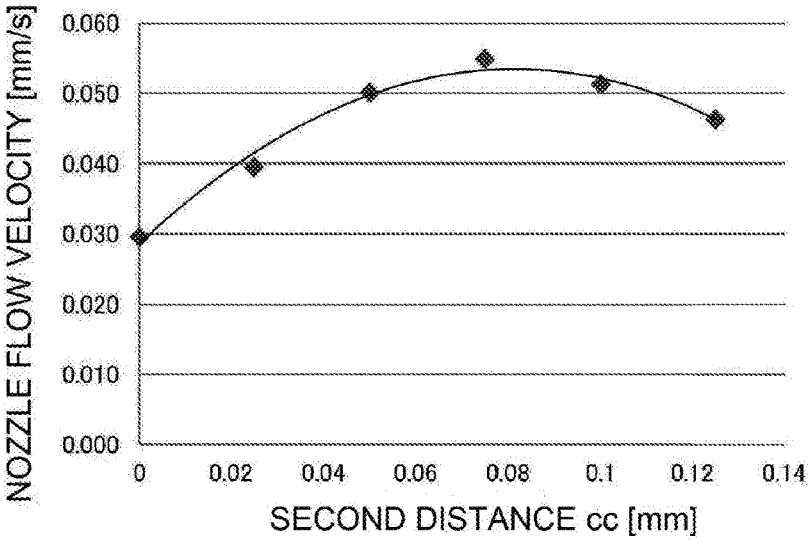
FIG. 4A is a graph showing a relationship between the nozzle flow velocity and the second distance in the liquid ejection head of FIG. 2.
Figure 4B:
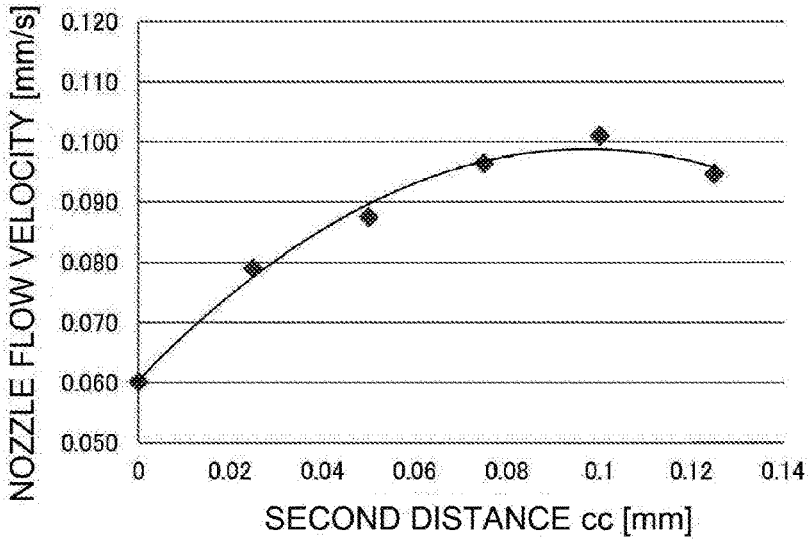
FIG. 4B is a graph showing a relationship between the nozzle flow velocity and the second distance in the liquid ejection head of FIG. 2.
Figure 4C:
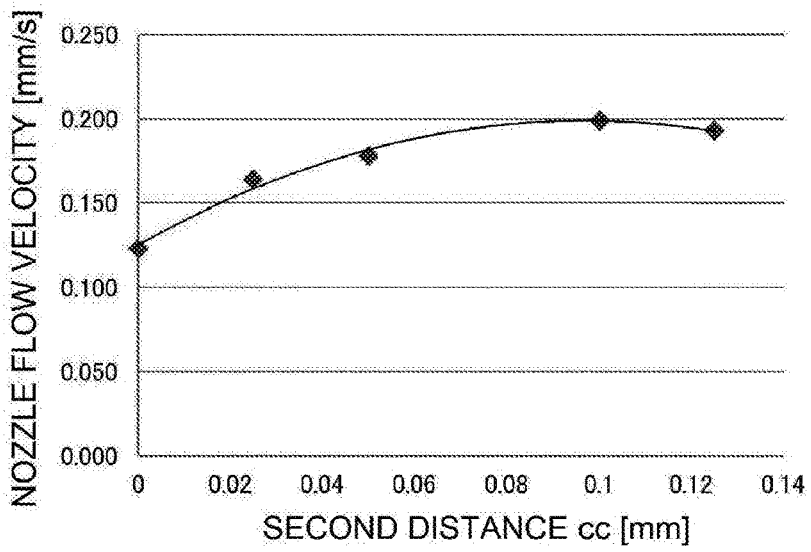
FIG. 4C is a graph showing a relationship between the nozzle flow velocity and the second distance in the liquid ejection head of FIG. 2.
Figure 5A:
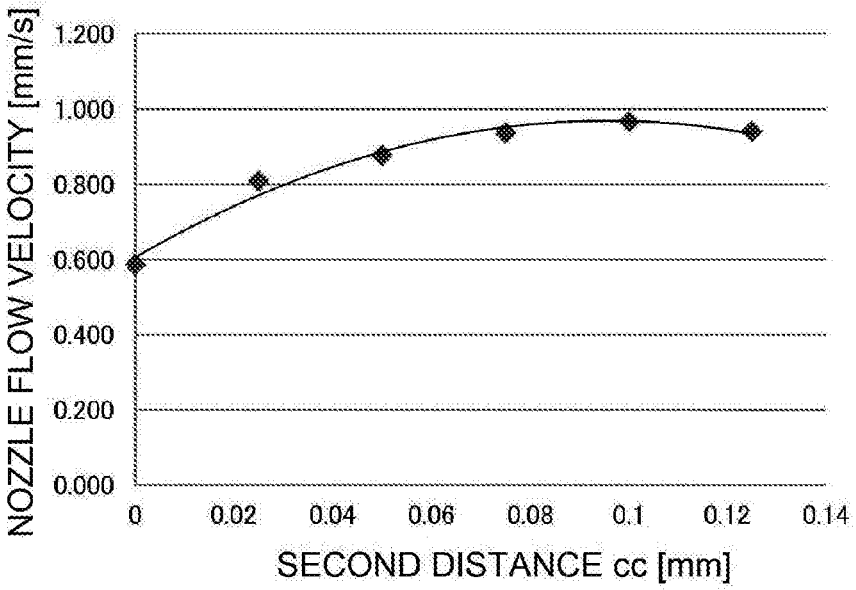
FIG. 5A is a graph showing a relationship between the nozzle flow velocity and the second distance in the liquid ejection head of FIG. 2.
Figure 5B:
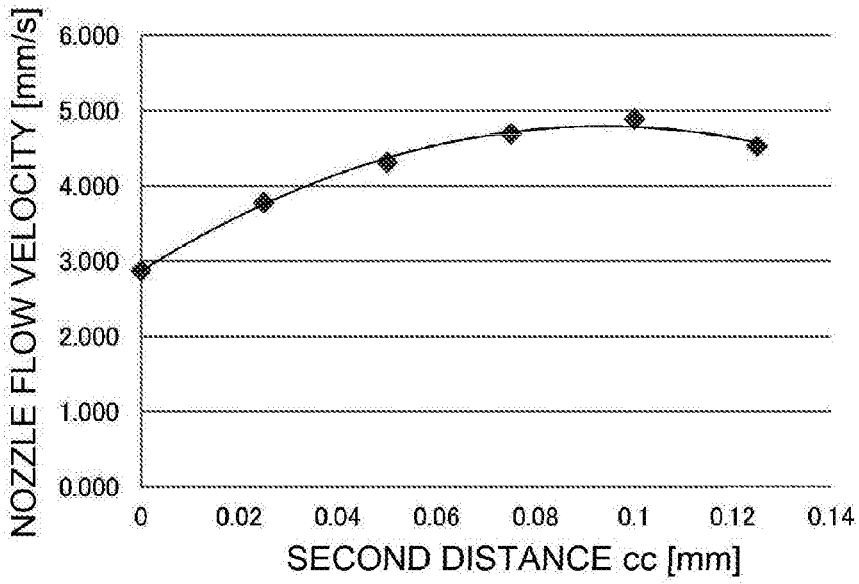
FIG. 5B is a graph showing a relationship between the nozzle flow velocity and the second distance in the liquid ejection head of FIG. 2.

As described above, each head 20 includes the channel unit and the volume changer. As shown in FIGS. 2 and 3, the channel unit is formed by a stack of a plurality of plates, and the volume changer includes a vibration plate 55 and piezoelectric elements 60.

The plurality of plates include a nozzle plate 40, a first channel plate 41, a second channel plate 42, a third channel plate 43, a fourth channel plate 44, a fifth channel plate 45, a sixth channel plate 46, a seventh channel plate 47, an eighth channel plate 48, a ninth channel plate 49, a 10th channel plate 50, an 11th channel plate 51, a 12th channel plate 52, a 13th channel plate 53, and a 14th channel plate 54. These plates are stacked in this order in a first direction.

Each plate has holes and grooves of various sizes. A combination of holes and grooves in the stacked plates of the channel unit define liquid channels such as a plurality of nozzles 21, a plurality of individual channels, a supply manifold 22, and a return manifold 23.

The nozzles 21 are formed to penetrate the nozzle plate 40 in the first direction. Ends of nozzles 21 (nozzle holes 21*a*) are arranged, as a nozzle array, in a third direction on the ejection surface 40*a* of the nozzle plate 40. The nozzles 21 will be described in detail later.

The third direction is orthogonal to the first direction and may be parallel or inclined relative to the orthogonal direction shown in FIG. 1. A second direction is a direction orthogonal to the first direction and crossing (e.g., orthogonal to) the third direction, and may be parallel or inclined relative to a scanning direction.

The supply manifold 22 and the return manifold 23 extend long in the third direction and are connected to the individual channels. The supply manifold 22 has a supply opening 22*a* at one end in its longitudinal direction, and the return manifold 23 has a return opening 23*a* at one end in its longitudinal direction. The supply manifold 22 is stacked on the return manifold 23 to overlap the return manifold 23 in the first direction.

The cross-sectional area (a third cross-sectional area) defined by the supply manifold 22 to face the third direction is equal to the cross-sectional area (a third cross-sectional area) defined by the return manifold 23 to face the third direction. For example, the supply manifold 22 and the return manifold 23 may be the same in size and shape. In this case, the supply manifold 22 and the return manifold 23 may have the same dimensions in the third direction, in the second direction, and in the first direction.

The supply manifold 22 is formed by through-holes penetrating in the first direction the eighth channel plate 48 through the 11th channel plate 51, and a recess recessed from a lower surface of the 12th channel plate 52. The recess overlaps the through-holes in the first direction. A lower end of the supply manifold 22 is covered by the seventh channel plate 47, and an upper end of the supply manifold 22 is covered by an upper portion of the 12th channel plate 52.

The return manifold 23 is formed by through-holes penetrating in the first direction the second channel plate 42 through the fifth channel plate 45, and a recess recessed from a lower surface of the sixth channel plate 46. The recess overlaps the through-holes in the first direction. A lower end of the return manifold 23 is covered by the first channel plate 41, and an upper end of the return manifold 23 is covered by an upper portion of the sixth channel plate 46.

The supply manifold 22 and the return manifold 23 define a buffer space 24 therebetween. The buffer space 24 is formed by a recess recessed from a lower surface of the seventh channel plate 47. In the first direction, the supply manifold 22 and the buffer space 24 are adjacent to each other via an upper portion of the seventh channel plate 47, and the return manifold 23 and the buffer space 24 are adjacent to each other via the upper portion of the sixth channel plate 46. The buffer space 24 sandwiched between the supply manifold 22 and the return manifold 23 may reduce interaction between the liquid flow pressure in the supply manifold 22 and the liquid flow pressure in the return manifold 23.

The plurality of individual channels are branched from the supply manifold 22 and merge into the return manifold 23. Each individual channel is connected at its upstream end to the supply manifold 22, at its downstream end to the return manifold 23, and at its midstream to a base end of a corresponding nozzle 21. Each individual channel includes a first communication hole 25, a first throttle channel 26, a second communication hole 27, a pressure chamber 28, a descender 29, a communication passage 30, a second throttle channel 31, and a third communication hole 32, which are arranged in this order.

The first communication hole 25 is connected, at its lower end, to an upper end of the supply manifold 22 and extends upward from the supply manifold 22 in the first direction to penetrate an upper portion of the 12th channel plate 52 in the first direction. The first communication hole 25 is offset to one side (a first side) from a center of the supply manifold 22 in the second direction. The cross-sectional area (a first cross-sectional area) defined by the first communication hole 25 to face the first direction is less than the third cross-sectional area of the supply manifold 22.

The first throttle channel 26 is connected, at its first-side end, to an upper end of the first communication hole 25 and extends toward a second side in the second direction. The first throttle channel 26 is formed by a groove recessed from a lower surface of the 13th channel plate 53. The cross-sectional area (a second cross-sectional area) defined by the first throttle channel 26 to face the second direction is less than the first cross-sectional area of the first communication hole 25.

The second communication hole 27 is connected, at its lower end, to a second-side end of the first throttle channel 26 and extends from the first throttle channel 26 upward in the first direction to penetrate an upper portion of the 13th channel plate 53 in the first direction. The second communication hole 27 is offset to the other side (a second side) from the center of the supply manifold 22 in the second direction. The cross-sectional area (a first cross-sectional area) defined by the second communication hole 27 to face the first direction is greater than the second cross-sectional area of the first throttle channel 26.

The pressure chamber 28 is connected, at its first-side end, to an upper end of the second communication hole 27, and extends toward a second side in the second direction. The pressure chamber 28 penetrates the 14th channel plate 54 in the first direction. The cross-sectional area (a second cross-sectional area) defined by the pressure chamber 28 to face the second direction is greater than or equal to a first cross-sectional area of the second communication hole 27.

For example, the descender 29 has an axis ad and cylindrical. The descender 29 penetrates the first through 13th plate channels 41-53 in the first direction and is located further to the second side in the second direction than the supply manifold 22 and the return manifold 23.

The descender 29 has a first end 29*a* (e.g., an upper end) in the first direction, and a second end 29*b* (e.g., a lower end) opposite to the first end 29*a*. The first end 29*a* is connected to a second-side end of the pressure chamber 28. When the second end 29*b* is circular, the second end 20*b* has, as a second dimension (e.g., a width) R in the second direction, a diameter of 0.05 mm or more and 0.15 mm or less.

The cross-sectional area (a first cross-sectional area) defined by the descender 29 to be orthogonal to the first direction is less than the cross-sectional area (a first cross-sectional area) defined by the pressure chamber 28 to be orthogonal to the first direction. The descender 29 may have the first cross-sectional area which is uniform or varies in the first direction. For example, the descender 29 may have a cross-sectional area, at the first end 29*a* and at the second end 29*b*, which is less than that of any other portion therebetween.

The communication passage 30 is connected, at its second-side end, to the second end 29*b* of the descender 29 and extends toward a first side in the second direction. The communication passage 30 penetrates the first channel plate 41 in the first direction.

The cross-sectional area (a second cross-sectional area) defined by the communication passage 30 to be orthogonal to the second direction is less than or equal to the first cross-sectional area of the descender 29. For example, it is preferable that the first cross-sectional area is greater than one time the second cross-sectional area and less than two times the second cross-sectional area. The communication passage 30 has a first dimension (e.g., a height) hc in the first direction, which is less than a second dimension R of the second end 20*b* and is, for example, greater than ⅔ times the second dimension R of the second end 29*b*.

The second throttle channel 31 is connected, at its second-side end, to a first-side end of the communication passage 30 and extends toward the first side in the second direction. The second throttle channel 31 is formed by a groove recessed from a lower surface of the first channel plate 41. The cross-sectional area (a second cross-sectional area) defined by the second throttle channel 31 to face the second direction is less than the second cross-sectional area of the communication passage 30.

The third communication hole 32 is connected, at its lower end, to an upper end of the second throttle channel 31 and extends from the second throttle channel 31 upward in the first direction to penetrate an upper portion of the first channel plate 41 in the first direction. The third communication hole 32 is connected, at its upper end, to a lower end of the return manifold 23. The third communication hole 32 is offset to the second side from a center of the return manifold 23 in the second direction. The cross-sectional area (a first cross-sectional area) defined by the third communication hole 32 to face the first direction is greater than the second cross-sectional area of the second throttle channel 31.

The vibration plate 55 is stacked on the 14th channel plate 54 to cover an upper opening of each pressure chamber 28. The vibration plate 55 may be integral with the 14th channel plate 54. In this case, each pressure chamber 28 is recessed from a lower surface of the 14th channel plate 54 in the first direction. An upper portion of the 14th channel plate 54, which is above each pressure chamber 28, functions as the vibration plate 55.

Each piezoelectric element 60 includes a common electrode 61, a piezoelectric layer 62, and an individual electrode 63 which are arranged in this order. The common electrode 61 entirely covers the vibration plate 55 via the insulating film 56. Each piezoelectric layer 62 is provided for a corresponding pressure chamber 28 and is located on the common electrode 61. Each individual electrode 63 is located on a corresponding piezoelectric layer 62 to overlap a corresponding pressure chamber 28. In this case, a piezoelectric element 60 is formed by an active portion of a piezoelectric layer 62, which is sandwiched by an individual electrode 63 and the common electrode 61.

Each individual electrode 63 is electrically connected to a driver IC. The driver IC receives control signals from the controller 13 (FIG. 1) and generates drive signals (voltage signals) selectively to the individual electrodes 63. In contrast, the common electrode 61 is constantly maintained at a ground potential.

In response to a drive signal, an active portion of each selected piezoelectric layer 62 expands and contracts in a surface direction, together with the two electrodes 61 and 63. Accordingly, the vibration plate 55 corporates to deform to increase and decrease the volume of a corresponding pressure chamber 28. This applies a pressure to the corresponding pressure chamber 28 which in turn ejects liquid from a nozzle 21.

Structure of Nozzle

As shown in FIGS. 2 and 3, the nozzle 21 extends in the first direction and has a distal-end opening (a nozzle hole 21*a*) and a base-end opening 21*b* opposite to the distal-end opening. For example, the nozzle 21 has a shape of a cone without a tip, and the area of the base-end opening 21*b* is greater than that of the nozzle hole 21*a*. The diameter of the base-end opening 21*b* is less than a dimension of the communication passage 30 in a direction orthogonal to the first direction and less than the second dimension R of the second end 29*b*. For example, the diameter is 0.02 mm or more and 0.04 mm or less.

The base-end opening 21*b* of the nozzle 21 and the second end 29*b* of the descender 29 are connected to a lower end of the communication passage 30. A first distance pc is greater than 0.5 times the second dimension R of the second end 29*b*. The first distance pc is the shortest distance between an outer periphery of the base-end opening 21*b* and the center cd of the second end 29*b*, that is, a distance between the center cd and the closest point of the outer periphery of the base-end opening 21*b* to the second end 29*b*.

In the second direction, a distance cc between the center cd of the second end 29*b* and the center cn of the base-end opening 21*b* is greater than, for example, the sum of the radius rd (=R/2) of the second end 29*b* and the radius m of the base-end opening 21*b*. For example, when the ratio of the first dimension hc of the communication passage 20 to the second dimension R of the second end 29*b* is 1 or less, the nozzle 21 is positioned such that a second distance cc is greater than 0.5 times and less than or equal to 2.5 times the second dimension R.

Thus, when viewed in the first direction, the second end 29*b* of the descender 29 does not overlap the base-end opening 21*b* of the nozzle 21. The base-end opening 21*b* is located at the communication passage 30 which is offset from the second end 29*b* toward the first side in the second direction.

The nozzle 21 has an axis an extending in the first direction. The descender 29 has an axis ad extending in the first direction. The communication passage 30 has an axis ac extending in the second direction. The axis an and the axis ad are spaced from each other in the second direction and intersect the axis ac of the communication passage 30. Thus, the center cn of the base-end opening 21*b* of the nozzle 21 and the center cd of the second end 29*b* of the descender 29 are located on a straight line parallel to the axis ac of the communication passage 30.

Liquid Flow

For example, the supply opening 22*a* of the supply manifold 22 is connected via a supply conduit to a subtank, and the return opening 23*a* of the return manifold 23 is connected, via a return conduit, to the subtank. When a pressure pump in the supply conduit and a negative-pressure pump in the return conduit are driven, liquid from the subtank passes through the supply conduit to flow into the supply manifold 22 where liquid flows in the third direction.

Meanwhile, liquid partially flows into the individual channels. In each individual channel, liquid flows from the supply manifold 22, via the first communication hole 25, into the first throttle channel 26 where liquid flows in the second direction. Liquid further flows from the first throttle channel 26, via the second communication hole 27, into the pressure chamber 28 where liquid flows in the second direction. Then, liquid flows from the first end 29*a* to the second end 29*b* of the descender 29 in the first direction, passes the communication passage 30 in the second direction, and passes the nozzle 21 in the first direction. When the piezoelectric element 60 applies an ejection pressure to the pressure chamber 28, liquid is ejected from the nozzle hole 21*a*. The flow velocity of the liquid flowing through the descender 29 in the first direction is 0.5 mm/s or more and 2.0 mm/s or less.

Remaining liquid further passes the communication passage 30 in the second direction to the second throttle channel 31 and flows, via the third communication hole 32, into the return manifold 23. Then, liquid passes the return manifold 23 in the third direction and returns through the return conduit to the subtank. Thus, liquid not having flown into the individual channels circulates between the subtank and the individual channels.

Relationship between Nozzle Position and Flow Velocity

When the piezoelectric element 60 applies pressure to liquid in the pressure chamber 28 downward in the first direction, the liquid flows from the pressure chamber 28, via the descender 29 and the communication passage 30, to the nozzle 21.

In this case, the flow velocity is highest at a center of the descender 29 in a direction orthogonal to the first direction and is lower at a portion thereof farther away from the center. A curved flow path is defined by the descender 29 extending in the first direction and by the communication passage 20 extending in the second direction. This may cause changes in centrifugal force and pressure and unbalance the velocity distribution. The flow velocity is lower at an outer portion of the curved flow path than at an inner portion thereof. The nozzle 21 is located at the outer portion. The flow velocity may be lowered at the nozzle 21 located at a portion where the liquid flow direction changes from the first direction to the second direction.

To cope with this, the nozzle 21 is positioned at the communication passage 30 such that the first distance pc is greater than 0.5 times the second dimension R of the second end 29*b*. By positioning the nozzle in the above-described range, the communication passage 20 has, at its cross-sectional area orthogonal to the second direction, a velocity distribution which is different from that in its curved portion and in which the flow velocity is higher in its lower end than in its upper end. The nozzle 21 positioned at a lower end of the above-described range provides a rapid liquid flow, which adequately discharges air bubbles adhering to an inner wall surface of the nozzle 21.

Graphs in FIGS. 4A, 4B, 4C, 5A, and 5B each show a relationship between the second distance cc and the nozzle flow velocity in the head 20. The nozzle flow velocity is a liquid flow velocity at the center cn of the base-end opening 21*b* of the nozzle 21.

In the head 20 associated with FIGS. 4A through 5B, the first dimension hc of the communication passage 30 in the first direction is equal to the second dimension R of the second end 29*b* of the descender 29. The first dimension hc is 0.05 mm In this case, the ratio of the first dimension hc to the second dimension R is 1.

The nozzle flow velocity has been obtained by changing the circulating flow velocity. The circulating flow velocity is a velocity of liquid circulating from the supply manifold 22, via a corresponding individual channel, to the return manifold 23, that is, a liquid flow velocity in the descender 29 in the first direction. The circulating flow velocity is 0.5 mm/s in FIG. 4A, 1 mm/s in FIG. 4B, 2 mm/s in FIG. 4C, 10 mm/s in FIG. 5A, and 50 mm/s in FIG. 5B.

In FIGS. 4A through 5B, the circulating flow velocity is in a range of 0.5 mm/s or more and 50 mm/s or less. In this range, the nozzle flow velocity is highest when the second distance cc is 0.075 mm or more and 0.125 mm or less. The nozzle 21 can be positioned at such a position that the flow velocity is high when the second distance cc is 1.5 times or more and 2.5 times or less the second dimension R.

As the circulating flow velocity is higher, the second distance cc that maximizes the nozzle flow velocity is greater. Thus, the nozzle 21 can positioned at a position where the flow velocity is high by setting the second distance cc greater as the circulating flow velocity is higher.

As shown in FIGS. 4A through 5B, in the case where the first dimension hc is equal to the second dimension R, the nozzle flow velocity is high when the second distance cc is in a range of 0.075 mm or more and 0.125 mm or less. In contrast, in the case where the first dimension hc is less than the second dimension R, the nozzle flow velocity is high in a range less than the above-described range. Thus, the nozzle 21 can be positioned at a position where the flow velocity is high by setting the second distance cc greater as the first dimension hc is greater.

Figure 6:
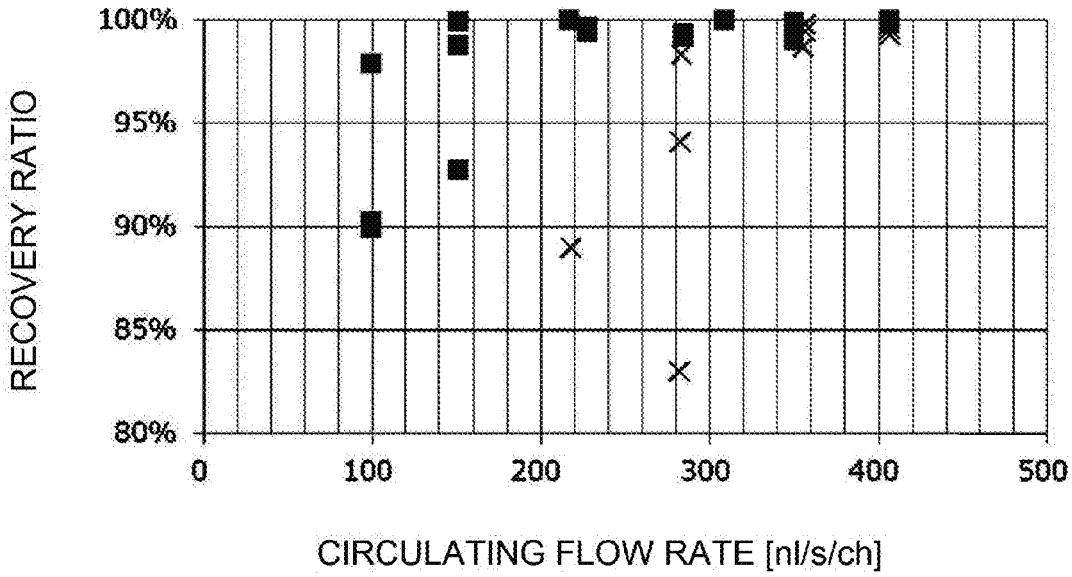
FIG. 6 is a graph showing a relationship between the recovery ratio and the circulating flow rate in the liquid ejection head of FIG. 2.

A graph in FIG. 6 shows a relationship between the circulating flow rate and the recovery ratio. The circulating flow rate is a flow rate of liquid flowing in an individual channel (e.g., a descender 29, a pressure chamber 28, and a communication passage 30).

The recovery ratio is a provability that air bubbles adhering to a wall surface of a nozzle 21 are discharged for a predetermined time (90 seconds). Specifically, an impact was given on a head 20 such that air enters through a nozzle hole 21*a* to disable a nozzle 21 to eject liquid therefrom. Then, liquid was circulated for 90 seconds. Thereafter, when liquid was ejected from the nozzle 21 upon application of pressure by a piezoelectric element 60, it was determined that the nozzle 21 was recovered. When liquid was not ejected from the nozzle 21 at that time, it was determined that the nozzle 21 was not recovered. This experiment was conducted on each head 20 a plurality of times. The recovery ratio was obtained by calculating the ratio of the number of times that liquid was ejected to the number of experiments conducted.

Square marks in the graph indicate recovery ratios. Cross marks indicate recovery ratios obtained in a known head in which a nozzle is positioned at a descender. The graph shows that the head 20 according to this illustrative embodiment has higher recovery ratios than the known head.

Positioning the nozzle 21 at a position where the flow velocity is high allows a rapid liquid flow to discharge, from the nozzle 21, air bubbles even adhering to an inner periphery of the nozzle 21. Additionally, when viewed in the first direction, the center cn of the nozzle 21 and the center cd of the second end 29*b* are located on the axis ac of the communication passage 30. Because the flow velocity is higher at portions closer to the centers or axis of these flow paths, the above-described arrangement provides a rapid liquid flow which is efficiently guided from the descender 29, via the communication passage 30, to the nozzle 21. Thus, the rapid liquid flow discharges air bubbles.

Effects

In the head 20, the first dimension hc of the communication passage 30 in the first direction is less than or equal to the second dimension R of the second end 29*b*. The nozzle 21 is positioned at the communication passage 30 such that the shortest distance (the first distance pc) between its outer periphery and the center cd of the second end 29*b* is greater than 0.5 times the second dimension R of the second end 29*b* in the second direction. Additionally, when viewed in the first direction, the center cn of a cross-section defined by the nozzle 21 to be orthogonal to an extending direction of the nozzle, and the center cd of the second end 29*b* intersect the axis ac of the communication passage 30.

The nozzle 21 at such a position is advantageous in that a liquid flow is directed from the descender 29 toward the nozzle 21 and that the liquid flow is high in velocity. Pressure loss in the liquid flow is reduced and thus liquid efficiently flows from the descender 29, via the communication passage 30, to the nozzle 21. Such a liquid flow discharges air bubbles adhering to a wall surface of the nozzle 21, thereby reducing ejection failures due to air bubbles.

In the head 20, when the ratio of the first dimension hc of the communication passage 20 in the first direction to the second dimension R of the second end 29*b* is 1 or less, the nozzle 21 is positioned such that the second distance cc between the center cn of the nozzle 21 and the center cd of the second end 29*b* is greater than 0.5 times and less than or equal to 2.5 times the second dimension R of the second end 29*b*. Positioning the nozzle 21 at such a position makes the flow velocity high at the nozzle 21 and allows a rapid liquid flow to discharge air bubbles from the nozzle 21.

In the head 20, when the second dimension R of the second end 29*b* is equal to the first dimension hc of the communication passage 30, the nozzle 21 is positioned such that the second distance cc between the center cn of the nozzle 21 and the center cd of the second end 29*b* is greater than 1.5 times and less than or equal to 2.5 times the second dimension R of the second end 29*b*. Positioning the nozzle 21 at such a position makes the flow velocity high at the nozzle 21 and allows a rapid liquid flow to discharge air bubbles from the nozzle 21.

In the head 20, when the second dimension R of the second end 29*b* is equal to the first dimension hc of the communication passage 30, the nozzle 21 is positioned such that the second distance cc between the center cn of the nozzle 21 and the center cd of the second end 29*b* is 0.075 mm or more and 0.125 mm or less. Positioning the nozzle 21 at such a position makes the flow velocity high at the nozzle 21 and allows a rapid liquid flow to discharge air bubbles from the nozzle 21.

In the head 20, the nozzle 21 is positioned such that the second distance cc between the center cn of the nozzle 21 and the center cd of the second end 29*b* is greater as the first distance hc of the communication passage 30 in the first direction is greater. Positioning the nozzle 21 in such a manner makes the flow velocity high at the nozzle 21.

In the head 20, the nozzle 21 is positioned such that the second distance cc between the center cn of the nozzle 21 and the center cd of the second end 29*b* is greater as the flow velocity of the liquid in the communication passage 30 is higher. Positioning the nozzle 21 in such a manner makes the flow velocity high at the nozzle 21.

In the head 20, the flow velocity of the liquid in the communication passage 30 is greater than or equal to 0.5 mm/s. Thus, a liquid flow from the supply manifold 22, via the communication passage 30, to the return manifold 23 discharges air bubbles from the communication passage 30, thereby reducing entry of air bubbles from the communication passage 30 into the nozzle 21. A liquid flow from the communication passage 30 into the nozzle 21 may prevent drying of a liquid meniscus in the nozzle hole 21*a*.

In the head 20, the flow velocity of liquid in the communication passage 30 is less than or equal to 50 mm/s. Thus, a meniscus in the nozzle hole 21*a* may be prevented from being broken by a liquid flow into the nozzle 21.

The head 20 includes a throttle channel (the second throttle channel 31) located opposite to the descender 29 relative to the communication passage 30. The throttle channel has a cross-sectional area orthogonal to the second direction which is less than the cross-sectional area defined by the communication passage 30 to be orthogonal to the second direction. The descender 29, the communication passage 30, and the second throttle channel 31 are connected in this order in the second direction. The nozzle 21 is connected to the communication passage 30 between the descender 29 and the second throttle channel 31. The second throttle channel 31 is narrower than the communication passage 30 and thus has a greater resistance to a liquid flow than the communication passage 30. Thus, the pressure applied by the piezoelectric element 60 acts on the nozzle 21, via the descender 29 and the communication passage 30, without passing through the second throttle channel 31. Also, the flow velocity is maintained high in the communication passage 30.

In the head 20, the second throttle channel 31 is formed in the first channel plate 41 to be recessed from the nozzle plate 40. The second throttle channel 31 having a smaller cross-sectional area makes the flow velocity high. Thus, air bubbles are discharged from the communication passage 30, via the second throttle channel 31, to the return manifold 23, thereby reducing ejection failures due to air bubbles.

First Modification

In a head 20 according to a first modification of the first illustrative embodiment, as shown in FIG. 2, the first dimension hc of the communication passage 30 in the first direction is greater than or equal to a first dimension (e.g., a height) hn of the nozzle 21 in the first direction. The elements other than the above-described elements are similar, in structure, function, and effect, to those of the first illustrative embodiment and will not be described repeatedly.

The communication passage 30 having a greater first dimension hc may reduce reflection, away from the nozzle 21 by the communication passage 30, of the liquid flowing from the descender 29 into the communication passage 30. This may prevent a reduction in liquid flow rate into the nozzle 21, thereby reducing ejection failures.

Second Modification

In a head 20 according to a second modification of the first illustrative embodiment, as shown in FIG. 3, the nozzle 21 is positioned at a center of the communication passage 30 in a direction orthogonal to the first direction. The elements other than the above-described elements are similar, in structure, function, and effect, to those of the first illustrative embodiment and will not be described repeatedly.

This makes the nozzle 21 distant from an adhesive agent which bonds the nozzle plate 40 and the first channel plate 41 and which may overflow into the communication passage 30. This may prevent the adhesive agent from reaching and clogging the nozzle.

Third Modification

Figure 7:
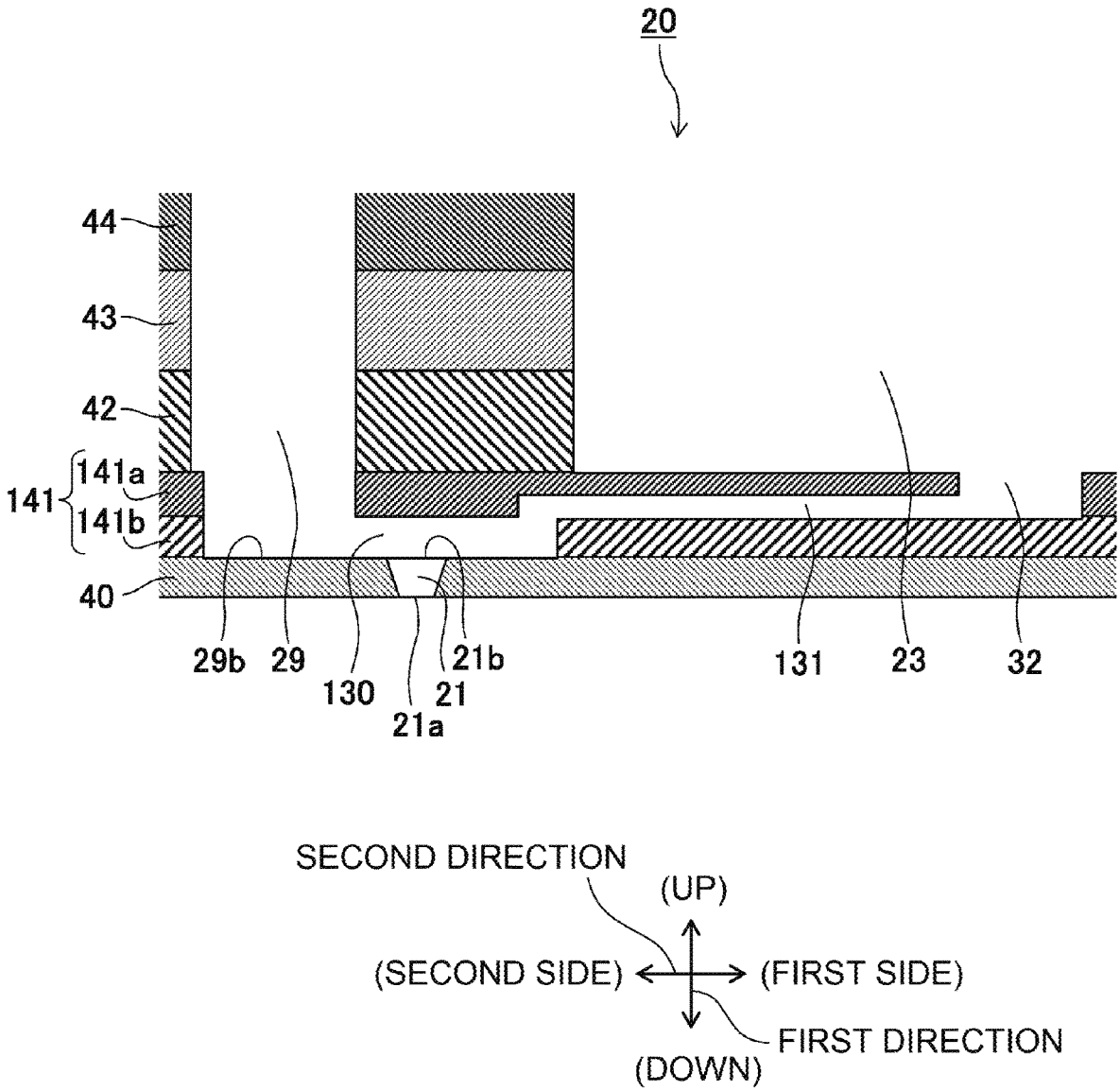
FIG. 7 is a cross-sectional view of a liquid ejection head according to a third modification of the first illustrative embodiment.

In a head 20 according to a third modification of the first illustrative embodiment includes, as shown in FIG. 7, a first channel plate 141 includes a first plate 141*a* and a second plate 141*b*. The first plate 141*a* is stacked on the nozzle plate 40 and defines therein a communication passage 130. The second plate 141*b* is stacked on the first plate 141*a* and defines therein a second throttle channel 131. The elements other than the above-described elements are similar, in structure, function, and effect, to those of the first illustrative embodiment and will not be described repeatedly.

The second throttle channel 131 is located above the communication passage 130. This allows air bubbles to exit from the communication passage 130 to the second throttle channel 131, thereby reducing ejection failures due to air bubbles.

While the disclosure has been described with reference to the specific embodiments thereof, these are merely examples, and various changes, arrangements and modifications may be applied therein without departing from the spirit and scope of the disclosure.

What is claimed is:

1. A liquid ejection head comprising:

a pressure chamber to which an ejection pressure is applied for liquid ejection from a nozzle;

a descender extending in a first direction and including a first end connected to the pressure chamber and a second end opposite to the first end; and a communication passage connected to the second end, extending in a second direction crossing the first direction, and having a first dimension in the first direction, wherein the nozzle is positioned at the communication passage such that a shortest distance between an outer periphery thereof and a center of the second end is greater than 0.5 times a second dimension of the second end in the second direction, wherein when viewed in the first direction, the center of the second end of the descender and a center of a cross-section defined by the nozzle to be orthogonal to an extending direction of the nozzle intersect an axis of the communication passage, and wherein the second dimension of the second end is 0.05 mm or more and 0.15 mm or less.

2. The liquid ejection head according to claim 1, wherein the first dimension of the communication passage is less than the second dimension of the second end.

3. The liquid ejection head according to claim 1, wherein when a ratio of the first dimension of the communication passage to the second dimension of the second end is 1 or less, the nozzle is positioned such that a distance between the center of the nozzle and the center of the second end is greater than 0.5 times and less than or equal to 2.5 times the second dimension of the second end.

4. The liquid ejection head according to claim 1, wherein when the second dimension of the second end is equal to the first dimension of the communication passage, the nozzle is positioned such that a distance between the center of the nozzle and the center of the second end is 1.5 times or more and 2.5 times or less the second dimension of the second end.

5. The liquid ejection head according to claim 1, wherein when the second dimension of the second end is equal to the first dimension of the communication passage, the nozzle is positioned such that a distance between the center of the nozzle and the center of the second end is 0.075 mm or more and 0.125 mm or less.

6. The liquid ejection head according to claim 1, wherein the nozzle is positioned such that a distance between the center of the nozzle and the center of the second end is greater as the first dimension of the communication passage is greater.

7. The liquid ejection head according to claim 1, wherein the nozzle is positioned such that a distance between the center of the nozzle and the center of the second end is greater as a flow velocity of liquid in the communication passage is higher.

8. The liquid ejection head according to claim 1, wherein a flow velocity of liquid in the communication passage is greater than or equal to 0.5 mm/s.

9. The liquid ejection head according to claim 1, wherein a flow velocity of liquid in the communication passage is less than or equal to 50 mm/s.

10. The liquid ejection head according to claim 1, wherein the first dimension of the communication passage is greater than or equal to a dimension of the nozzle in the first direction.

11. The liquid ejection head according to claim 1, wherein the nozzle is positioned at a center of the communication passage in a direction orthogonal to the first direction.

12. The liquid ejection head according to claim 1, further comprising a throttle channel located opposite to the descender relative to the communication passage, wherein the throttle channel has a cross-sectional area orthogonal to the second direction and less than a cross-sectional area defined by the communication passage to be orthogonal to the second direction.

13. The liquid ejection head according to claim 12, further comprising:

a nozzle plate including the nozzle; and a channel plate stacked on the nozzle plate and including the communication passage, and the throttle channel formed therein to be recessed from the nozzle plate.

14. The liquid ejection head according to claim 13, wherein the channel plate includes:

a first plate stacked on the nozzle plate and including the communication passage; and a second plate stacked on the first plate and including the throttle channel.

15. A liquid ejection head comprising:

a pressure chamber to which an ejection pressure is applied for liquid ejection from a nozzle;

a descender extending in a first direction and including a first end connected to the pressure chamber and a second end opposite to the first end; and a communication passage connected to the second end, extending in a second direction crossing the first direction, and having a first dimension in the first direction, wherein the nozzle is positioned at the communication passage such that a shortest distance between an outer periphery thereof and a center of the second end is greater than 0.5 times a second dimension of the second end in the second direction, wherein when viewed in the first direction, the center of the second end of the descender and a center of a cross-section defined by the nozzle to be orthogonal to an extending direction of the nozzle intersect an axis of the communication passage, and wherein when a ratio of the first dimension of the communication passage to the second dimension of the second end is 1 or less, the nozzle is positioned such that a distance between the center of the nozzle and the center of the second end is greater than 0.5 times and less than or equal to 2.5 times the second dimension of the second end.

16. The liquid ejection head according to claim 15, wherein the first dimension of the communication passage is less than the second dimension of the second end.

17. The liquid ejection head according to claim 15, wherein the nozzle is positioned such that the distance between the center of the nozzle and the center of the second end is greater as the first dimension of the communication passage is greater.

18. The liquid ejection head according to claim 15, wherein the nozzle is positioned such that the distance between the center of the nozzle and the center of the second end is greater as a flow velocity of liquid in the communication passage is higher.

19. The liquid ejection head according to claim 15, wherein a flow velocity of liquid in the communication passage is greater than or equal to 0.5 mm/s.

20. The liquid ejection head according to claim 15, wherein a flow velocity of liquid in the communication passage is less than or equal to 50 mm/s.

21. The liquid ejection head according to claim 15, wherein the first dimension of the communication passage is greater than or equal to a dimension of the nozzle in the first direction.

22. The liquid ejection head according to claim 15, wherein the nozzle is positioned at a center of the communication passage in a direction orthogonal to the first direction.

23. The liquid ejection head according to claim 15, further comprising a throttle channel located opposite to the descender relative to the communication passage, wherein the throttle channel has a cross-sectional area orthogonal to the second direction and less than a cross-sectional area defined by the communication passage to be orthogonal to the second direction.

24. The liquid ejection head according to claim 23, further comprising:

a nozzle plate including the nozzle; and a channel plate stacked on the nozzle plate and including the communication passage, and the throttle channel formed therein to be recessed from the nozzle plate.

25. The liquid ejection head according to claim 24, wherein the channel plate includes:

a first plate stacked on the nozzle plate and including the communication passage; and a second plate stacked on the first plate and including the throttle channel.

* * * * *